US006254142B1

(12) United States Patent
Kaifel et al.

(10) Patent No.: US 6,254,142 B1
(45) Date of Patent: Jul. 3, 2001

(54) EXHAUST MANIFOLD FLANGE FOR AN INTERNAL COMBUSTION ENGINE

(75) Inventors: Hans-Joerg Kaifel, Schorndorf; Hans A. Haerle, Bopfingen, both of (DE)

(73) Assignee: Daimler-Benz Aktiengesellschaft, Stuttgart (DE)

( * ) Notice: Subject to any disclaimer, the term of this patent is extended or adjusted under 35 U.S.C. 154(b) by 0 days.

(21) Appl. No.: 09/032,235

(22) Filed: Feb. 27, 1998

(30) Foreign Application Priority Data

Mar. 1, 1997 (DE) ..... 197 08 392

(51) Int. Cl.[7] ..... F01N 7/00; F16L 39/00

(52) U.S. Cl. ..... 285/124.1; 60/323; 285/416; 285/124.3; 285/288.1; 29/890.09

(58) Field of Search ..... 285/416, 124.1, 285/124.3, 788.1; 165/173; 29/890.09; 60/323

(56) References Cited

U.S. PATENT DOCUMENTS

| | | | | |
|---|---|---|---|---|
| 1,208,022 | * | 12/1916 | Schlacks | 285/124.2 |
| 2,873,098 | * | 2/1959 | Morgan | 165/173 |
| 3,052,452 | * | 9/1962 | Taga | 165/173 |
| 3,179,449 | * | 4/1965 | Markisen | 285/368 |
| 3,275,346 | * | 9/1966 | Gregg | 285/416 |
| 4,105,227 | * | 8/1978 | Ekberg et al. | 285/416 |
| 4,226,280 | * | 10/1980 | Hellouin de Cenival | 285/192 |
| 4,465,129 | * | 8/1984 | Baldensperger et al. | 285/124.1 |
| 4,615,500 | * | 10/1986 | Layson | 248/65 |
| 4,777,708 | * | 10/1988 | Harwood | 29/890.08 |
| 5,413,389 | * | 5/1995 | Schlicht | 285/416 |
| 5,718,046 | * | 2/1998 | Wang | 29/890.08 |
| 5,916,137 | * | 6/1998 | Hayashi | 60/323 |

FOREIGN PATENT DOCUMENTS

| | | | | |
|---|---|---|---|---|
| 474058 | * | 5/1951 | (CA) | 285/416 |
| 2144799 | * | 12/1972 | (DE) | 285/416 |
| 2806312 | * | 8/1979 | (DE) | 285/416 |
| 3005813 | * | 9/1981 | (DE) | 60/323 |
| 3841529 | * | 6/1990 | (DE) | 285/416 |
| 4025652 | * | 5/1991 | (DE) | 285/416 |
| 4315086 | * | 11/1994 | (DE) | 60/323 |
| 93 16 960 | | 3/1995 | (DE) . | |
| 296 12 841 U1 | | 9/1996 | (DE) . | |
| 296 15 840 U1 | | 10/1996 | (DE) . | |
| 25070 | * | 3/1981 | (EP) | 285/416 |
| 250326 | * | 11/1986 | (JP) | 60/323 |

* cited by examiner

*Primary Examiner*—Eric K. Nicholson
(74) *Attorney, Agent, or Firm*—Davis and Bujold

(57) ABSTRACT

An exhaust manifold flange for an internal combustion engine, for sealably connecting at least one stub pipe of an exhaust manifold to a wall of the engine, the flange has a basic part made of sheet steel provided with a bead which extends substantially around the entire outer contour of the basic part, at least one receiving hole with another bead therearound for securely receiving the at least one stub pipe in the manifold which has holes which are arranged for attaching the exhaust manifold flange to the wall of the internal combustion engine.

10 Claims, 2 Drawing Sheets

EXHAUST MANIFOLD FLANGE FOR AN INTERNAL COMBUSTION ENGINE

The invention relates to an exhaust manifold flange for an internal combustion engine of the type defined in more detail in the preamble of claim 1.

The prior art discloses exhaust manifolds which are realized as cast parts and have a cast-on flange.

However, these known exhaust manifold flanges which are attached to the cylinder head of the internal combustion engine have the disadvantage that they are heavy in weight and are relatively expensive to manufacture. The heavy weight of the known exhaust manifold flanges results in the further disadvantage that they draw too much heat from the exhaust gas in the starting phase of the internal combustion engine, with the result that the downstream catalytic converter is able to convert the exhaust gas only after a delay.

A further disadvantage of the known exhaust manifold flanges is that the high weight and the center of gravity of the exhaust manifold flange which is at a large distance from the internal combustion engine leads to undesired vibrations of the internal combustion engine. This is problematic in particular in the case of internal combustion engines fabricated from aluminum or aluminum alloys.

The object of the invention is therefore to provide an exhaust manifold flange which is low in weight and can thus contribute to reducing the consumption of the internal combustion engine. In addition, the exhaust manifold flange is intended to make a contribution to being able to fulfill the more stringent conditions of the new exhaust gas legislation, to have lower production costs and, furthermore, to have sufficient flexural strength despite its low weight.

This object is achieved according to the invention by means of the features specified in the characterizing part of claim 1.

The inventive basic part made of sheet metal results in a considerably reduced weight of the entire exhaust manifold flange since the sheet metal can be of very thin design. In order, nevertheless, to achieve a high degree of rigidity, the basic part is provided according to the invention with a bead on its outer contour and/or circumferentially. As a result of the beads with which the at least one receiving hole is also provided, a further increase in the rigidity, in particular in the flexural strength, of the exhaust manifold flange according to the invention is advantageously obtained.

Moreover, it is advantageous that the stub pipes which can be inserted securely into the receiving holes result in a sealed connection in order to extract to exhaust gas from an internal combustion engine.

Further advantageous refinement possibilities of the invention emerge from the sub claims and from the following exemplary embodiment described in principle with reference to the drawing, in which:

Figure 1:
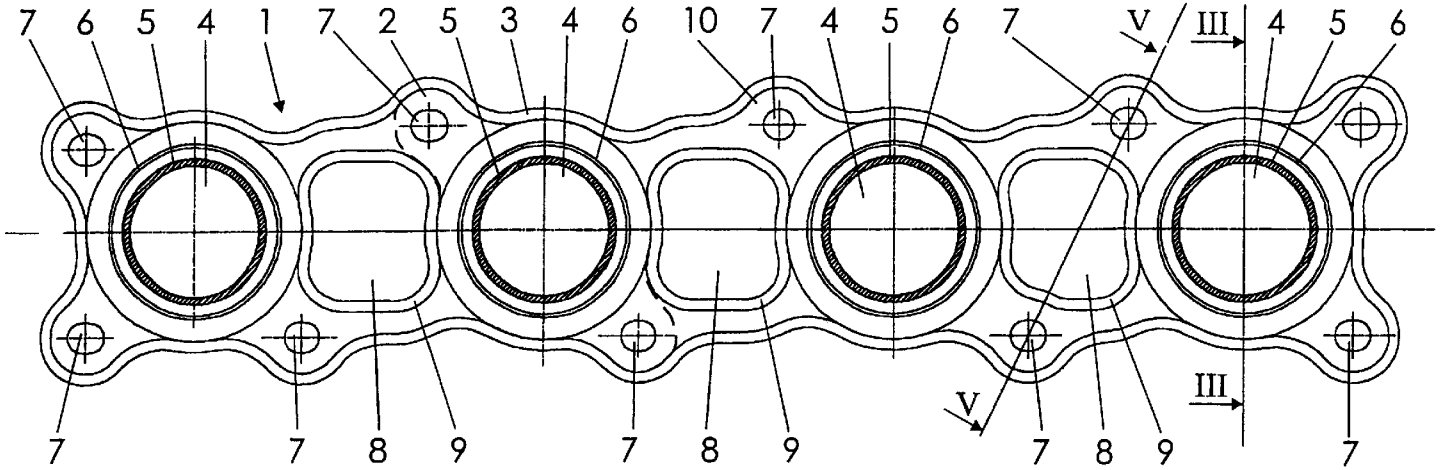
FIG. 1 shows a plan view of an embodiment of the exhaust manifold according to the invention.

FIG. 1 illustrates an exhaust manifold flange 1 with a basic part 2 which has a circumferential bead 3.

Moreover, receiving holes 4 for exhaust pipes or stub pipes 5 are located in the basic part 2. The receiving holes 4 are likewise provided with beads 6 which are arranged in a ring shape around the receiving holes 4.

In order to attach the exhaust manifold flange 1 to a cylinder head of an internal combustion engine (not illustrated), there are attachment means with holes 7 in the basic part 2. In order to save weight, the basic part 2 is provided with additional intermediate cut-outs 8 between the receiving holes 4. In order to increase the rigidity of the exhaust manifold flange 1, the intermediate cut-outs 8 are provided with beads 9, in the same way as the basic part 2 and the receiving holes 4.

The dashed line in FIG. 1 shows that the intermediate cut-outs 8 are provided in the basic part 2 in such a way that the remaining areas are in the shape of individual flanges 10. This constitutes a further way of optimizing the rigidity of the exhaust manifold flange 1.

In a further (not illustrated) embodiment of the exhaust manifold flange 1, it is possible for the basic part 2 to be reshaped by stamping, in order to increase the rigidity of the exhaust manifold flange 1 additionally. Furthermore, it is possible to straighten the basic part 2 by punching it flat with a smooth or swaged flattening die (not illustrated) and/or to ball blast the entire exhaust manifold flange 1. Such a measure contributes particularly to increasing the stress endurance.

Figure 2:
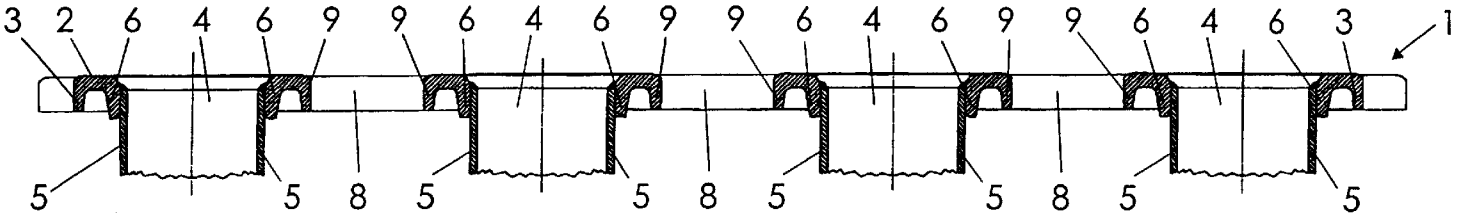
FIG. 2 shows a section along the line II—II in FIG. 1.

FIG. 2 illustrates, in addition to the illustration according to FIG. 1, the welding of the stub pipes 5 to the receiving holes 4 on the beads 6. This welding is carried out from a side of the exhaust manifold flange 1 facing the internal combustion engine. In the process, the receiving holes 4 can be fabricated with a very high level of dimensional accuracy. The receiving holes 4 can be realized, for example, with a tolerance in the H7 range, and the stub pipes 5 can have slight over-dimensioning. The form fit which is produced in this way increases the stress endurance of the welded connection. Moreover, FIG. 2 shows the extensions and/or heights as well as the wall thicknesses of the beads 3, 6 and 9.

The beads 3, 6 and 9 are ironed by cold shaping, it being possible to influence the magnitude of the extension of the beads 3, 6 and 9 by means of the degree of shaping. In this process, the beads 3, 6 and 9 are strain hardened. When the beads 3, 6 and 9 are stretched approximately two to four times in relation to the wall thickness of the basic part 2, the flexural strength of the beads 3, 6 and 9 reaches an optimum value. In practice, the wall thickness of the basic part 2 is 2–4 mm, whereas the beads 3, 6 and 9 have an extension of 6–10 mm.

The cut edges produced on the exhaust manifold flange 1 as a result of the shaping can be rounded off by moulding on radii (not illustrated), this permitting the risk of injury from sharp edges to be reduced. In addition, in one embodiment (not illustrated) of the invention, the upper edges of the beads 3, 6 and 9 can be remelted or alloyed up. This contributes to an additional increase in the flexural strength of the exhaust manifold flange 1.

Figure 3:
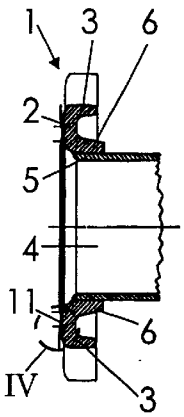
FIG. 3 shows a section along the line III—III in FIG. 1.

FIG. 3 shows a section through the exhaust manifold flange 1, a circumferential elevation 11 on the underside of the basic part 2 facing the internal combustion engine being illustrated. The circumferential elevation 11 forms a sealing face together with the wall of the internal combustion engine, no additional sealing means being required for this. This is because the exhaust manifold flange 1 then does not bear with its entire surface against the internal combustion engine, as a result of which the pressure on the sealing face increases several times. This sealing can be improved by making the circumferential elevation 11 of convex or conical design. The height of the circumferential elevation 11 is usually between 0.1–2 mm. The circumferential elevation 11 reduces the absorption of heat of the exhaust manifold flange 1 in the starting phase of the internal combustion engine.

Figure 4:
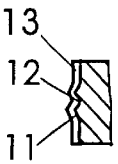
FIG. 4 shows an enlarged view along the line IV in FIG. 3.

However, if it is desired to obtain additional sealing, it is possible to provide the circumferential elevation 11 with a circumferential depression 12. A sealing ring (not illustrated) or any other sealing means, which can be of very simple design, can be inserted into the depression 12. The elevation 11 and the depression 12 formed in it can be seen more precisely in the enlarged view in accordance with FIG. 4.

In order to reduce the transmission of heat between the exhaust manifold flange 1 and the internal combustion engine, the sealing face is provided with a ceramic coating (not illustrated).

For the raw material of the exhaust manifold flange 1, various substances can be used, inter alia even sheet steel with a plurality of sheet layers and different rolling directions. A selective combination of materials enables the coefficients of thermal expansion between the exhaust manifold flange 1 and the internal combustion engine to be matched. For this reason, an exhaust manifold flange made of aluminum or of an aluminum or magnesium alloy is, of course, also conceivable within the scope of the invention.

Figure 5:
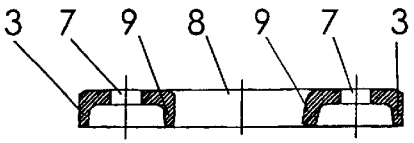
FIG. 5 shows a section along the line V—V in FIG. 1.

FIG. 5 shows a section through the exhaust manifold flange 1, two different embodiments of the bead 9 being illustrated.

Figure 8:
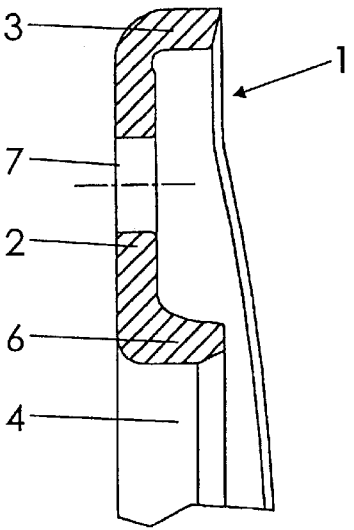
FIG. 8 shows an enlarged view along the line VIII in FIG. 7.
Figure 7:
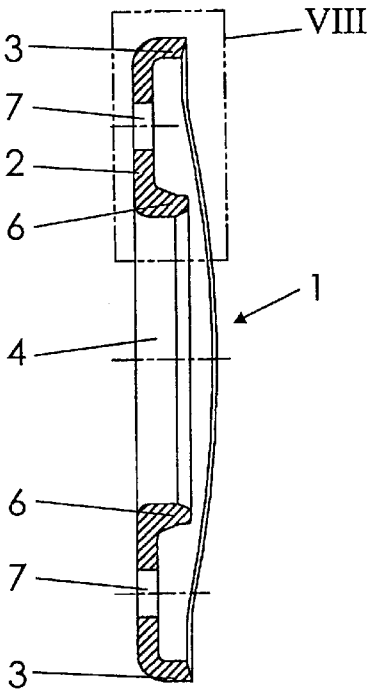
FIG. 7 shows a section along the line VII—VII in FIG. 6.
Figure 6:
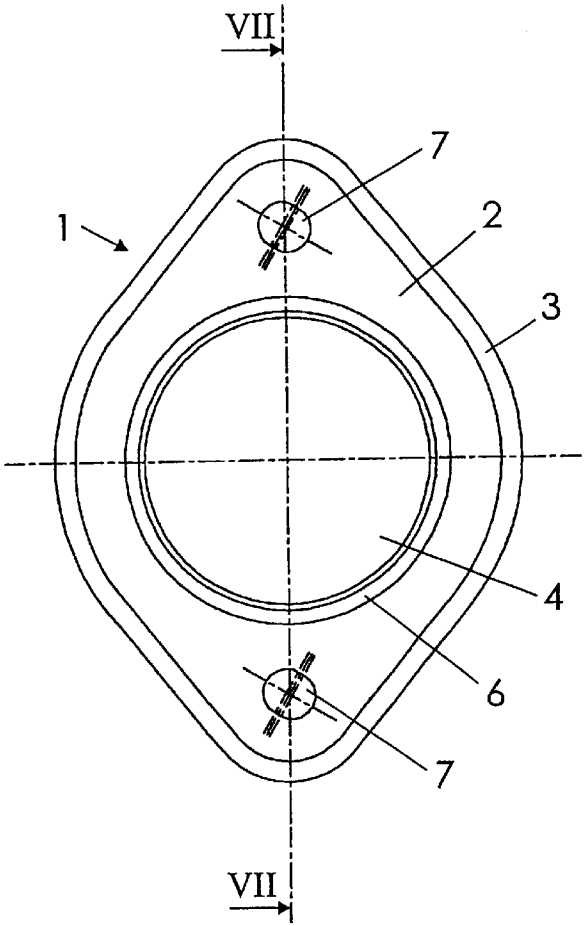
FIG. 6 shows plan view of a further embodiment of the exhaust manifold according to the invention.

FIGS. 6 to 8 show a further embodiment of the exhaust manifold flange 1 which is designed in this case as an individual flange 1 and has only one receiving hole 4 for the stub pipe 5, which is not yet attached in this case and is therefore not represented. In order to equip an internal combustion engine with a plurality of cylinders, a corresponding number of individual flanges 1 for attachment to the cylinder head of the internal combustion engine have to be provided in this case.

The individual flange 1 is likewise provided with a circumferential bead 3, in the same way as the receiving hole 4 is provided with a bead 6.

FIG. 8 shows the cross-section of the bead 6 more precisely, the width of said cross-section increasing in the direction of the basic part 2. The bead 6 is designed on its side facing away from the receiving hole 4 in the form of a so-called tractrix curve. This widening of the bead, together with the formation of a tractrix curve, increases the stress endurance of the bead 6.

Of course, the bead 6 of the exhaust manifold flange 1 illustrated in FIGS. 1 to 5 may also be designed with a tractrix curve.

What is claimed is:

1. An exhaust manifold for use with an internal combustion engine comprising:

at least one stub pipe (5); and an exhaust manifold flange to provide a gas tight connection between a cylinder head of the internal combustion engine and the exhaust manifold, the exhaust manifold flange having a basic part (2) made of sheet steel including a first bead (3) which extends substantially around an entire outer circumference of the basic part (2);

the basic part (2) defining at least one receiving hole (4) sealably receiving and fast with the at least one stub pipe (5), said receiving hole (4) being provided with a second bead (6) extending substantially around an entire circumference of the receiving hole; and attachment holes (7) formed in the basic part (2) to facilitate attachment of the exhaust flange to a wall of the internal combustion engine, wherein a diametrical cross-section of the second bead (6) around the receiving hole (4) defines a portion of greater width in the direction of the basic part (2), and an outer circumferential wall of the second bead (6) facing away from the receiving hole (4) has the form of a tractrix curve.

2. The exhaust manifold according to claim 1, wherein the at least one stub pipe (5) is welded into the at least one receiving hole (4) of the basic part (2).

3. The exhaust manifold according to claim 1 wherein the first, second and a third beads (3, 6, 9) each have an extension which extends in heights from the basic part (2) approximately two to four times the relative magnitude of a wall thickness of the basic part (2).

4. The exhaust manifold according to claim 1, wherein an engine contacting side of the basic part (2) comprises a sealing face defining a circumferential elevation (1) to facilitate complete sealed contact between the engine contacting side of the basic part (2) of the exhaust manifold flange and a wall of the internal combustion engine.

5. The exhaust manifold according to claim 4, wherein the circumferential elevation (11) is one of convex and conical design.

6. The exhaust manifold according to claim 4, wherein a depression (12) is formed in the circumferential elevation (11).

7. The exhaust manifold according to claim 4, wherein the sealing face is provided with a ceramic coating (13).

8. An exhaust manifold for use with an internal combustion engine comprising:

at least one stub pipe (5); and an exhaust manifold flange to provide a gas tight connection between a cylinder head of the internal combustion engine and the exhaust manifold, the exhaust manifold flange having a basic part (2) made of sheet steel including a first bead (3) which extends substantially around an entire outer circumference of the basic part (2);

the basic part (2) defining at least one receiving hole (4) sealably receiving and fast with the at least one stub pipe (5), said receiving hole (4) being provided with a second bead (6) extending substantially around an entire circumference of the receiving hole;

attachment holes (7) formed in the basic part (2) to facilitate attachment of the exhaust flange to a wall of the internal combustion engine, wherein a plurality of receiving holes (4) are defined by the basic part (2) and intermediate cutouts (8) are provided in the basic part (2) between adjacent receiving holes (4) and the intermediate cutouts (8) facilitate each receiving hole (4) having substantially, an individual flange shape (10).

9. The exhaust manifold according to claim 8 wherein each intermediate cutouts (8) is provided with a third bead (9) extending substantially around a circumference of the cutout (8).

10. An exhaust manifold for an internal combustion engine comprising:

at least one stub pipe (5); and an exhaust manifold flange to provide a gas tight connection between a cylinder head of the internal combustion engine and the exhaust manifold, the exhaust manifold flange having a basic part (2) made of sheet steel including a first bead (3) which extends substantially around an entire outer circumference of the basic part (2)

the basic part (2) defining at least one receiving hole (4) for sealably receiving the at least one stub pipe (5) in the basic part (2), said receiving hole (4) being provided with a second bead (6) extending substantially around an entire circumference of the receiving hole;

attachment holes (7) formed in the basic part (2) to facilitate attachment of the exhaust flange to a wall of the internal combustion engine; and wherein a diametrical cross-section of the second bead (6) around the receiving hole (4) has a greatest thickness closest to the basic part (2), and an outer circumferential wall of the second bead (6) facing away from the receiving hole (4) has the form of a tractrix curve.

* * * * *